US007389831B2

(12) United States Patent
Mullins et al.

(10) Patent No.: US 7,389,831 B2
(45) Date of Patent: Jun. 24, 2008

(54) DUAL-MEMBER AUGER BORING SYSTEM

(75) Inventors: H. Stanley Mullins, Perry, OK (US); Jerry W. Beckwith, Perry, OK (US); Kelvin P. Self, Stillwater, OK (US); Brent G. Stephenson, Stillwater, OK (US); Floyd R. Gunsaulis, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 166 days.

(21) Appl. No.: 11/106,205

(22) Filed: Apr. 14, 2005

(65) Prior Publication Data

US 2008/0073123 A1 Mar. 27, 2008

Related U.S. Application Data

(60) Provisional application No. 60/562,029, filed on Apr. 14, 2004.

(51) Int. Cl.
*E21B 7/28* (2006.01)

(52) U.S. Cl. ..... 175/62; 175/215; 175/323; 175/325.5

(58) Field of Classification Search ..... 175/61, 175/62, 215, 325.5, 323; 166/241.6
See application file for complete search history.

(56) References Cited

U.S. PATENT DOCUMENTS

| | | | | |
|---|---|---|---|---|
| 1,547,461 A | | 7/1925 | Steele | |
| 1,801,968 A | | 4/1931 | Montgomery | |
| 1,932,068 A | * | 10/1933 | Englebright et al. | 173/24 |
| 2,165,666 A | | 7/1939 | Tilly | 255/20 |
| 2,951,680 A | | 9/1960 | Camp et al. | 255/1.8 |
| 3,232,360 A | | 2/1966 | Dickinson | 175/62 |
| 3,526,285 A | | 9/1970 | Adkins et al. | 175/73 |
| 3,767,836 A | | 10/1973 | Geis et al. | 175/24 |
| 3,894,402 A | | 7/1975 | Cherrington | 61/72.4 |
| 3,902,563 A | | 9/1975 | Dunn | 175/62 |
| 3,945,443 A | | 3/1976 | Barnes | 175/73 |
| 3,951,220 A | | 4/1976 | Phillips, Jr. et al. | 175/393 |
| 4,003,440 A | | 1/1977 | Cherrington | 175/61 |
| 4,016,944 A | | 4/1977 | Wholfeld | 175/92 |
| 4,043,136 A | | 8/1977 | Cherrington | 61/72.7 |
| 4,043,410 A | * | 8/1977 | Bennett et al. | 175/323 |
| 4,156,471 A | | 5/1979 | Wagner | 175/394 |
| 4,280,732 A | | 7/1981 | Haspert | 299/11 |
| 4,506,931 A | | 3/1985 | Haspert | 299/1 |
| 4,553,612 A | | 11/1985 | Durham | 175/122 |
| RE32,267 E | | 10/1986 | Cherrington | 175/53 |
| 4,682,661 A | | 7/1987 | Hughes et al. | 175/215 |
| 4,726,711 A | | 2/1988 | Tian | 405/184 |

(Continued)

*Primary Examiner*—Giovanna C Wright
(74) *Attorney, Agent, or Firm*—Tomlinson & O'Connell, PC

(57) ABSTRACT

A system for boring horizontal boreholes and installing products using a dual member drill string. The system is comprised of a boring machine with a frame and a rotary drive supported on the frame, a downhole tool, and a dual member drill string. The drill string comprises an inner member disposed within a tubular outer member such that the inner member is rotatable independent of the outer member. The outer member has at least one helical projection supported on an exterior surface of the outer member. The projections on the outer member function as an auger to clear spoils and support the bore. The auger arrangement with the dual member drill string can be used in forward reaming or backreaming operations.

2 Claims, 11 Drawing Sheets

U.S. PATENT DOCUMENTS

| | | | | | |
|---|---|---|---|---|---|
| 4,790,395 | A | | 12/1988 | Gacket et al. | 175/102 |
| 4,878,547 | A | | 11/1989 | Lennon | 175/53 |
| 5,148,875 | A | | 9/1992 | Karlsson et al. | 175/62 |
| 5,314,267 | A | | 5/1994 | Osadchuk | 405/184 |
| 5,375,669 | A | * | 12/1994 | Cherrington | 175/53 |
| 5,386,878 | A | | 2/1995 | Rowekamp | 175/62 |
| 5,452,967 | A | | 9/1995 | Fuller | 405/184 |
| 5,673,762 | A | | 10/1997 | Pennington | 175/20 |
| 5,782,310 | A | | 7/1998 | Lange | 175/323 |
| 5,873,421 | A | | 2/1999 | Assenza | 175/121 |
| 5,919,005 | A | | 7/1999 | Rupiper | 405/244 |
| 5,937,954 | A | | 8/1999 | Puttmann et al. | 175/61 |
| 6,206,109 | B1 | | 3/2001 | Monier et al. | 175/53 |
| 6,478,512 | B2 | | 11/2002 | Sherwood | 405/232 |
| 6,585,043 | B1 | * | 7/2003 | Murray | 166/241.3 |
| 6,688,408 | B2 | | 2/2004 | Barbera et al. | 175/45 |
| 2002/0046882 | A1 | | 4/2002 | Smith, Jr. | 175/19 |

* cited by examiner

DUAL-MEMBER AUGER BORING SYSTEM

CROSS REFERENCE TO RELATED APPLICATION

This application claims the benefit of U.S. Provisional Application No. 60/562,029, filed on Apr. 14, 2004, the contents of which are incorporated herein fully by reference.

FIELD OF THE INVENTION

The present invention principally relates to the field of horizontal directional drilling. More particularly, the present invention is directed to improved apparatus and methods for creating substantially horizontal near-surface boreholes useful for such purposes as the installation of underground utility services, such as pipes and/or cables. Although preferably implemented as part of a conventional dual-member drill string equipped horizontal directional drilling ("HDD") system, some of the features described herein may also be usefully employed in a conventional single-member drill string HDD system—as well as in non-directional drilling systems.

SUMMARY OF THE INVENTION

The present invention is directed to a dual member drill pipe for use in horizontal directional drilling. The drill pipe comprises an elongate hollow outer member having an inner surface and an exterior surface and having a pin end and a box end, an elongate inner member, and at least one helical projection on the exterior surface of the outer member. The inner member is disposed within the outer member such that it is rotatable independent of the outer member. Each helical projection makes at least one rotation around the outer member.

In another embodiment the invention comprises a system for use in horizontal boring. The system comprises a boring machine comprising a frame and a rotary drive supported on the frame, a downhole tool, and a drill string having a first end connectable to the rotary drive and a second end connected to the downhole tool. The drill string comprises an outer tubular shaft having an exterior surface, an inner member disposed within the outer member such that the inner member is rotatable independent of the outer member, and at least one helical projection supported on the exterior surface of the outer shaft.

In yet a further embodiment, the present invention is directed to a method for boring a horizontal borehole using a dual member drill string. The method comprises rotating a cutting tool using a first member of the dual member drill string and clearing spoils and drilling fluids by rotating an auger using a second member of the dual member drill string.

In still another embodiment, the present invention comprises a method for boring a horizontal borehole. The method comprises boring a first portion of a borehole using a single member drill string and boring a next portion of the borehole using a dual member drill string having a plurality of helical projections supported on an outer surface of the drill string. The helical projections contact a wall of the borehole during the boring.

DETAILED DESCRIPTION OF THE PREFERRED EMBODIMENTS

Figure 1:
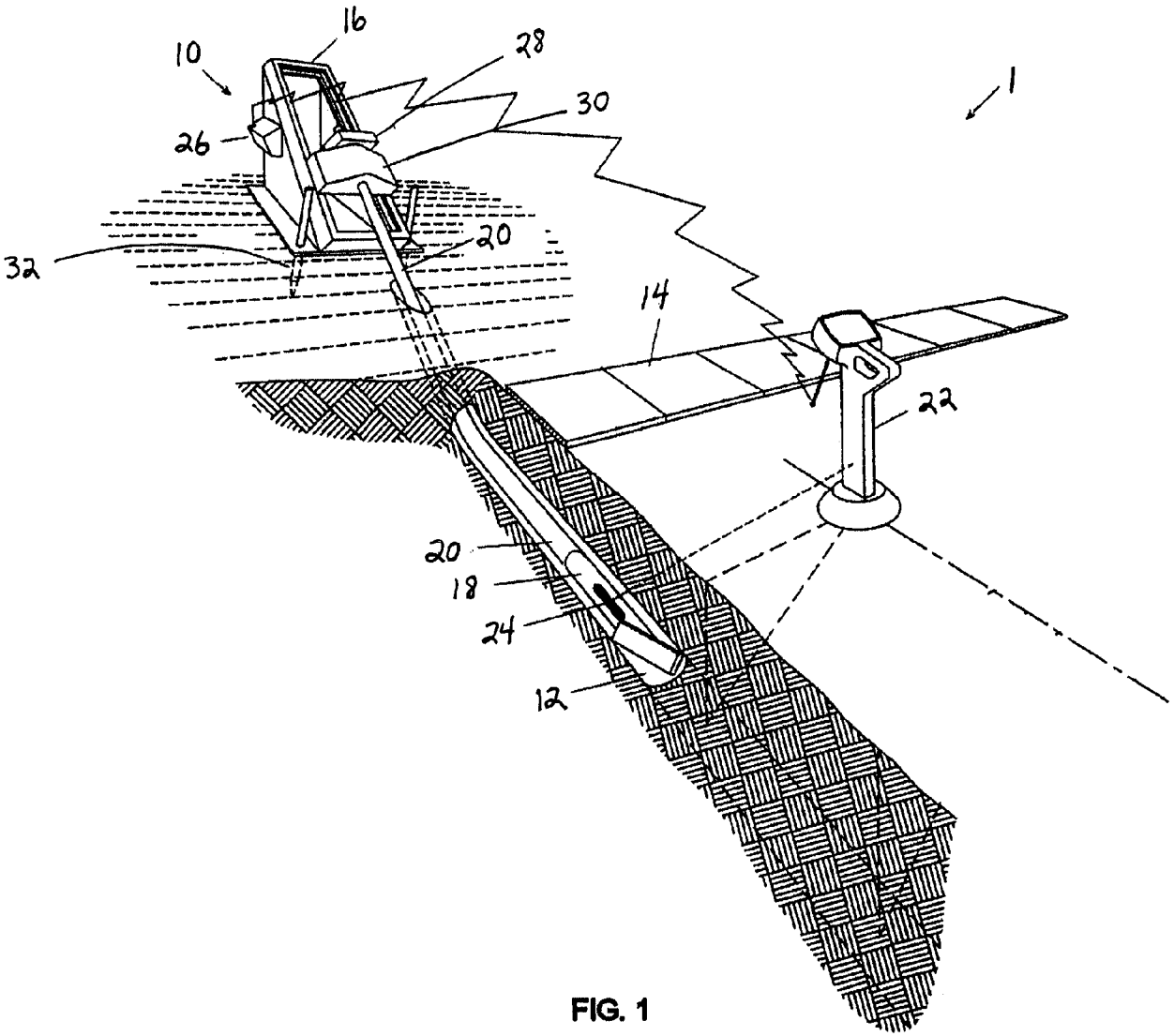
FIG. 1 is a diagrammatic representation of a drilling machine and system having a dual-member drill string built in accordance with the present invention.

Turning now to the figures in general and to FIG. 1 in particular, shown therein is a conventional HDD system 1 comprising a boring machine 10, suitable for drilling a borehole 12 and near-horizontal subsurface placement of utility services, for example under the roadway denoted by reference numeral 14. The boring machine 10 comprises a frame 16 and drives a downhole tool assembly 18 connected at the end of a drill string 20. The downhole tool assembly 18 preferably comprises a directional assembly for guiding the direction of the borehole 12. The typical HDD borehole 12 begins from the ground surface as an inclined segment that is gradually leveled off as the desired product installation depth is neared. This near horizontal path 12 may be maintained for the specified length of the product installation. Generally, the downhole directional assembly 18 is then directed upward to exit the ground surface in a drilling segment of similar or steeper incline to that of the entry segment. Drilling fluids are typically pumped down the drill string 20 to lubricate the drilling process, aid the stabilization of the borehole 12, cool the downhole electronics, and to flow any non-recompacted cuttings out of the hole. The present invention is suitable for use with an HDD system 1 as described above, but may also have additional applications. For instance in the removal of spoil (cuttings), air may be substituted for bentonite-style drilling fluids. A pit-launched style of HDD system is also readily adaptable to the present invention, and may be preferred in applications where negotiating a sharply curved entry-to-horizontal borepath transition poses difficulty.

The drilling machine 10 of the HDD system 1 is operatively connected by the drill string 20 to the directional downhole tool assembly 18. The tool assembly 18 may be any one of several possible downhole tool assemblies suitable for either creating the borehole 12 or later upsizing its original diameter sufficiently to accept pullback installation of the desired utility services or product pipe (not shown). The HDD system 1 may further comprise a tracking receiver 22 positioned at one of several reference placement stations and a downhole transmitter or beacon 24 containing one or more sensors, such as a pitch sensor and a roll (tool face) sensor. The progression of borehole 12 along a desired path is facilitated by information communicated between tracking receiver 22 and a control station 26 of the HDD system 1. The operation of HDD system 1 and its drilling machine 10 may be controlled manually through a system of levers, switches or similar controls at the control station 26. Alternatively, the control station 26 may comprise a system that automatically operates and coordinates the various functions comprising the drilling operation.

Figure 2:
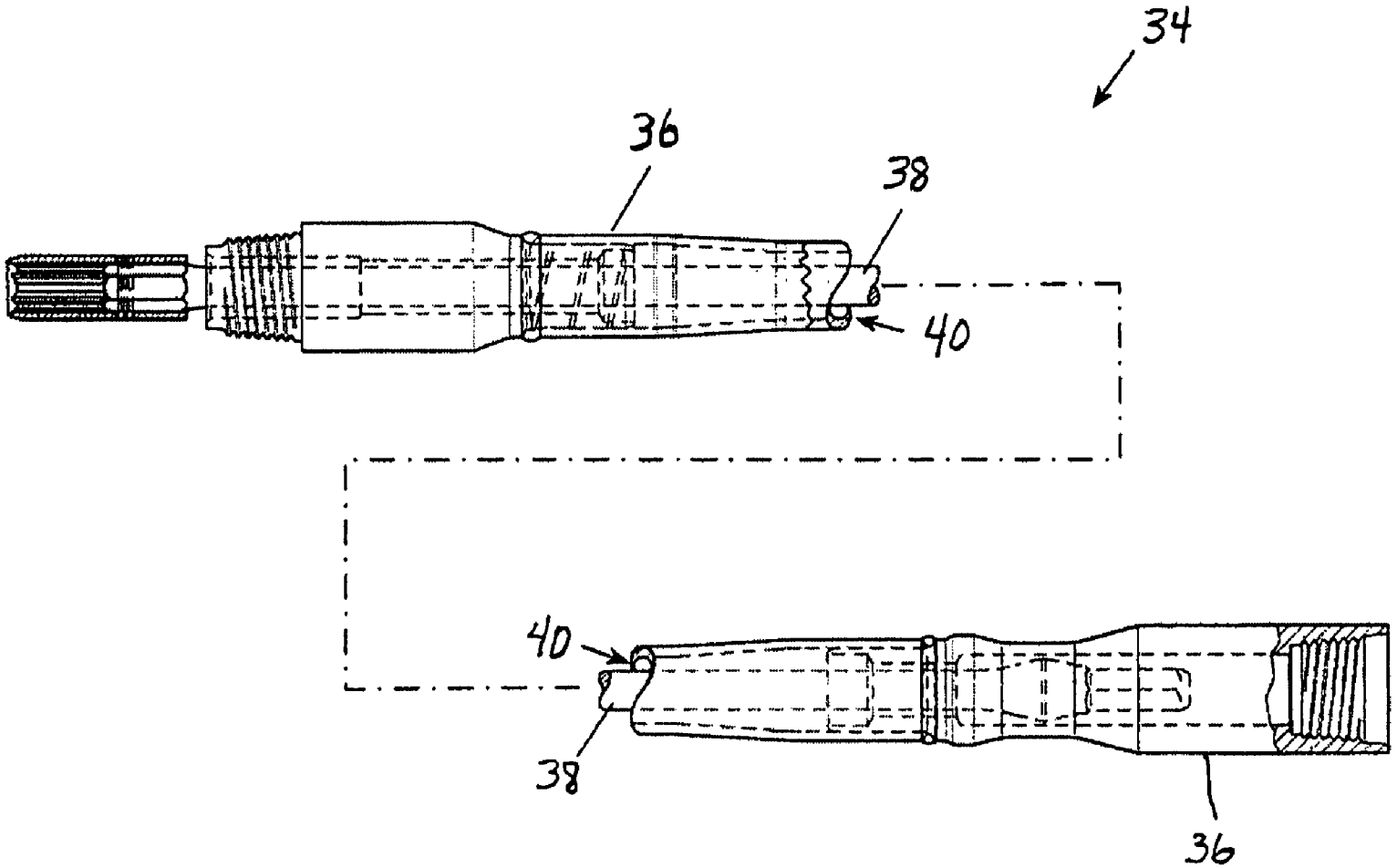
FIG. 2 is a fragmented, side elevational, partly sectional view of a dual-member pipe section suitable to be used in a dual-member drill string.
Figure 3:
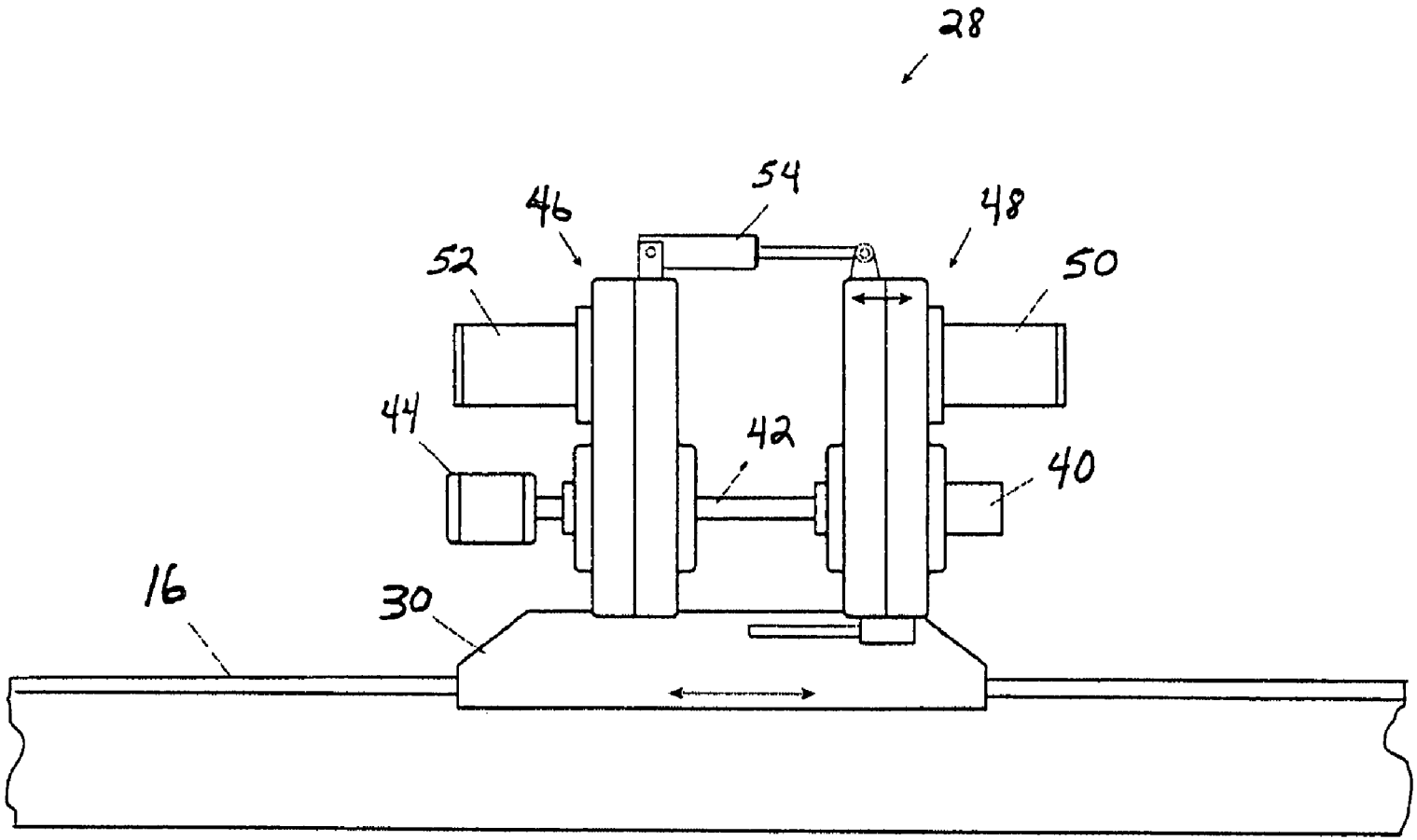
FIG. 3 is a fragmented, side elevational, partly sectional view of a dual rotary drive usable with boring machine of the present invention.

Referring now to FIGS. 2 and 3, the drill string 20 may be a dual-member drill string as shown, comprised of an outer drill string surrounding an inner drill string. For use with a dual member drill string 20, the drilling machine 10 is equipped with a rotary drive system 28. The rotary drive system 28 is movably supported by a carriage 30 on the frame 16. Movement of the carriage 30 and rotary drive system 28, by way of an axial advancement means (not shown), between a first position and a second position along the frame 16 axially advances the drill string 20 and directional downhole tool assembly 18 to create borehole 12. The drill string 20 transmits the thrust of carriage 30 and torque of rotary drive system 28 to downhole tool assembly 18 for drilling subsurface borehole 12. Reactionary forces on the drilling machine 10 may be resisted by machine weight supplemented by earth anchors 32 (FIG. 1). As is necessary at times, the downhole tool assembly 18 may be disengaged from the earth at the distant end of the borehole 12 by retraction of the drill string 20 through reverse movement (to that described above) of the carriage 30.

With continued reference to FIG. 2, there is shown therein a dual-member pipe section 34 suitable for assembly into a dual-member drill string 20. The pipe section 34 is comprised of an outer member 36 with male and female matingly threaded ends for threading to correspondingly threaded ends of adjacent pipe sections. The pipe section 34 is further comprised of an inner member 38 with corresponding male and female geometrically shaped ends. Interconnected inner members 38 of adjacent dual-member pipe sections 34 are rotatable independently of the interconnected outer members 36. An annular space 40 between the inner members 38 and outer members 36, or a hollow tubular construction for the inner member (not illustrated), may be useful for conveyance of drilling fluid downhole for purposes outlined above. One or the other of these longitudinal cavities may also be useful for conveyance of slurried drill cuttings uphole for disposal. It will be appreciated that any dual-member drill string having an outer member and an inner member, the inner member disposed within the outer member and independently rotatable, may be used with the present invention. Embodiments for suitable dual member drill strings 20 are described in U.S. Pat. No. 5,490,569, U.S. Pat. No. 5,682,956 and its reissue RE38,418, the contents of which are incorporated herein by reference.

Referring again to FIG. 3, a preferred embodiment for the rotary drive system 28 is shown. This rotary drive system 28 has separately driven spindles 40 and 42 for individually controlling the rotation of the outer member 36 and inner members 38 (FIG. 2) of the dual-member drill string 20. A fluid swivel 44 is shown connected to the inner spindle 42, useful for instance to pump drilling fluid downhole through hollow inner members of the drill string 38. Alternatively, the fluid swivel 44 may be located at the front or rear end of the outer spindle 40. The dual-spindle rotary drive system 28 further comprises two drive groups 46 and 48 for independently driving the respectively interconnected outer members 36 and interconnected inner members 38 of the dual-member drill string 20. The outer members 36 and inner members 38 are separately rotationally controlled by independent operation of the outer 50 and inner 52 drive motors. For instance, as is advantageous with the present invention, one of the drill string members 36 or 38 can be held without rotation or rotated at a substantially different speed than the other of the two drill string members are rotated.

The rotary drive system 28 is slidably mounted on the inclined frame 16 of drilling machine 10 by way of a carriage 30. For purposes later described, it may also be advantageous for the inner 40 and outer drive spindles 42 to be supported in a manner that they can be displaced axially with respect to each other—thereby advancing or retracting the inner drill string members 38 with respect to the outer drill string members 36. This relative motion may be accomplished, for instance, by slidably supporting the outer member drive group 48 upon the carriage 30 and displacing it axially with respect to the inner member drive group 46 by way of a linear actuator such as the hydraulic cylinder 54. Thus, in a particular operational mode, the carriage 30 may advance the inner member drive group 46 while the slidably supported outer member drive group 48 could be held with little or no forward movement (for only a short interval) by retraction of the hydraulic cylinder 54. In that way, the inner drill string 38 is advanced with respect to the outer drill string 36. One skilled in the art can readily envision other inner member 38 and outer member 36 relative translation modes made possible, such as one or more telescopic drill pipe segments.

A dual-spindle rotary drive system 28 adaptable to the above purposes is disclosed in previously referenced U.S. Pat. No. 5,682,956. Additional details on the operation of a HDD system 1 equipped with a dual-spindle rotary drive 28 are given in commonly owned application Ser. No. 10/724,572, incorporated herein by its reference.

Figure 4A:
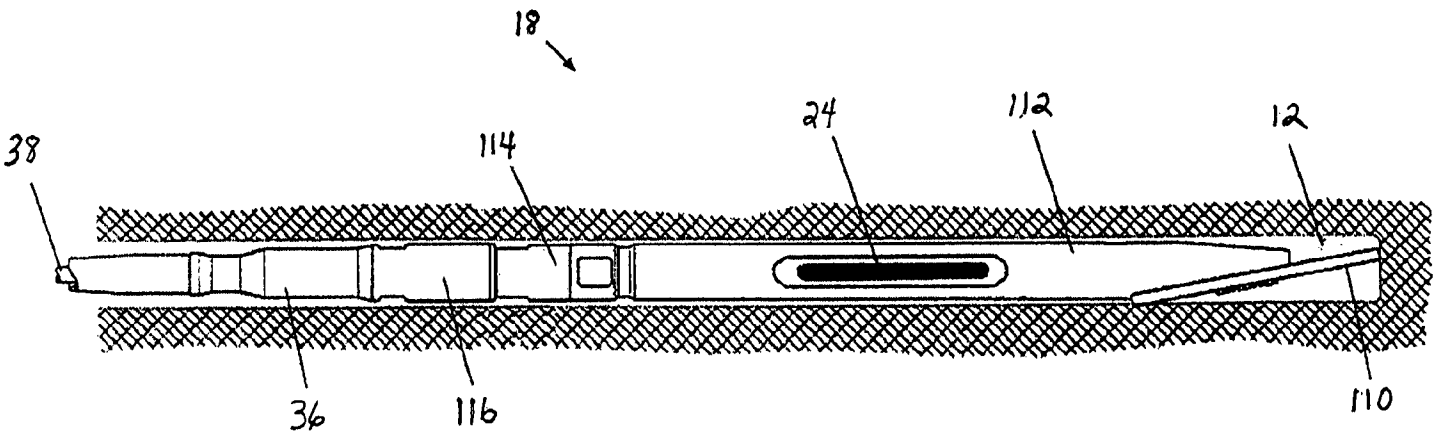
FIGS. 4*a* and FIG. 4*b* are diagrammatic side views of alternative embodiments of downhole directional tool assemblies for use with the present invention.
Figure 4B:
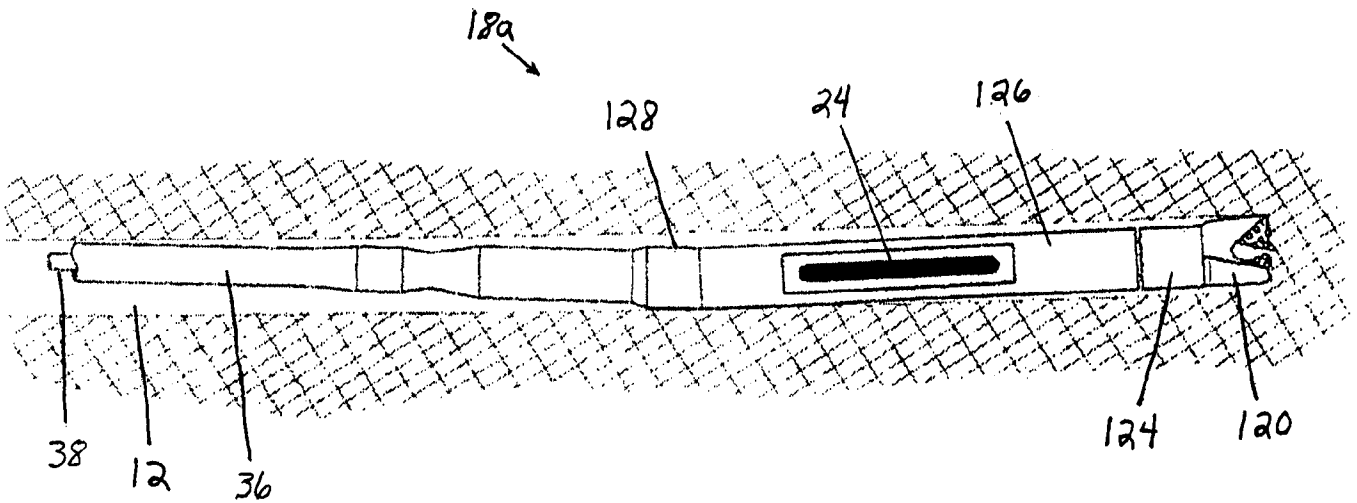

With reference now to FIGS. 4*a* and 4*b*, shown therein are alternative embodiments for directional downhole tool assembly 18 for use with a dual-member drill string 20. The directional downhole tool assembly 18 of FIG. 4*a* is suitable for creating boreholes in normal soils, whereas the directional downhole tool assembly 18*a* of FIG. 4*b* is useful for drilling boreholes in hard soil or soft to medium hardness rock. These and other types of directional downhole tool assemblies may be utilized with the present invention.

The directional downhole tool assembly 18 of FIG. 4*a* comprises a plate-style bit 110 removably attached to the inclined nose of a forward housing assembly 112 containing the downhole transmitter or beacon 24. The housing assembly 112 is rotationally fixed to the downhole end of the inner drill string 38 by way of an inner drive member 114 bearingly supported inside (not shown) a bearing housing assembly 116—the latter being fixedly attached to the downhole end of the outer drill string 36. Thus the inner drill string 38 is utilized to rotate the bit 110 while the outer drill string 36 may be independently rotated or held substantially without rotation. Rotating the bit 110 while it is advanced creates straight segments of the borehole 12. Orienting the slanted face of the bit 110 in the desired direction—with the aid of the beacon 24 roll (tool face) sensor (not shown)—and advancing without rotation of the inner drill string 38 initiates a borepath directional change. The tool 18 and its operation are described in more detail in commonly assigned U.S. Pat. No. 6,827,158, incorporated herein by its reference.

The directional downhole tool assembly 18*a* of FIG. 4*b* comprises a tri-cone bit 120 (or other suitable bit) attached to the downhole end of the inner drill string 38 by way of an adapter end 124 of an inner drive member bearingly supported (not shown) inside a bearing housing assembly 126. The housing assembly 126 is fixedly attached to the downhole end of the outer drill string 36 by way of a "bent" end cap 128. The two components 126 and 128 comprise a "bent" housing assembly, which may be independently rotated or held substantially without rotation by the outer drill string 36 while the inner drill string 38 is utilized to rotate the bit 120. The bearing housing assembly 126 further contains the downhole transmitter or beacon 24.

In typical operation of the downhole tool assembly 18*a*, the inner drill string 38 continuously rotates the bit 120 while it is being advanced to create the borehole 12. To create straight segments of the borehole 12, the outer drill string 36 either slowly rotates the "bent" housing assembly 126 or alternates the position of its bend between an up-down or left-right orientation every few feet of advance. Orienting this bend in a desired direction—with the aid of the beacon 24 roll (tool face) sensor (not shown)—and advancing without rotation of the outer drill string 36 initiates a borepath directional change.

With reference again to FIG. 3, the relative motion feature of advancing or retracting the inner drill string 38 with respect to the outer drill string 36 may be utilized to activate and deactivate redirection of a purpose-built downhole tool assembly 18. Use of relative motion allows the directional capability of a downhole tool 18 to be deployed selectively only when needed; e.g., to create a curved borehole or to correct an unplanned deviation from the desired path. This is advantageous in that the downhole tool 18 has no continual bias having to be overcome—by one of the previously described operating techniques—whenever creation of a straight borehole segment is desired. Such a directionally deployable downhole tool 18 (whether deployed by relative motion of a dual-member drill string, by hydraulically actuated downhole radial motion, or otherwise) frees up the rotational mode of the outer drill string 38 to be dedicated for yet to be described purposes of the present invention. When utilizing a directionally deployable downhole tool 18 actuated by one of the methods described above, it may be advantageous to equip the downhole end of the outer drill pipe 36 with a second beacon (not shown), the first beacon 24 being installed in the deployable downhole tool mounted at the downhole end of the inner drill string 38. Such a dual-beacon tracking system is disclosed in commonly owned application Ser. No. 10/724,572, previously incorporated by reference.

Most HDD downhole tool assemblies 18 rely on the flow of drilling fluid to convey non-recompacted cuttings out of the borehole 12 as it is being created or upsized. Certain soil types and/or operational situations adversely affect the hole-cleaning effectiveness of this process. This could endanger successful completion of the project utilizing conventional HDD systems. For instance, larger cuttings of clay soils can be difficult to break down into particles small enough to be suspendable in the drilling fluid, whereas granular cuttings can quickly settle out of drilling fluid suspension within the substantially horizontal borehole 12. The present invention addresses the needs of enhanced particle suspension and of improved conveyance of drill cuttings out of the borehole 12. The invention also addresses these needs for special types of HDD systems, such as those utilizing particle-creating dry boring techniques and high volume (velocity) air for spoil (cuttings) conveyance.

Figure 5:
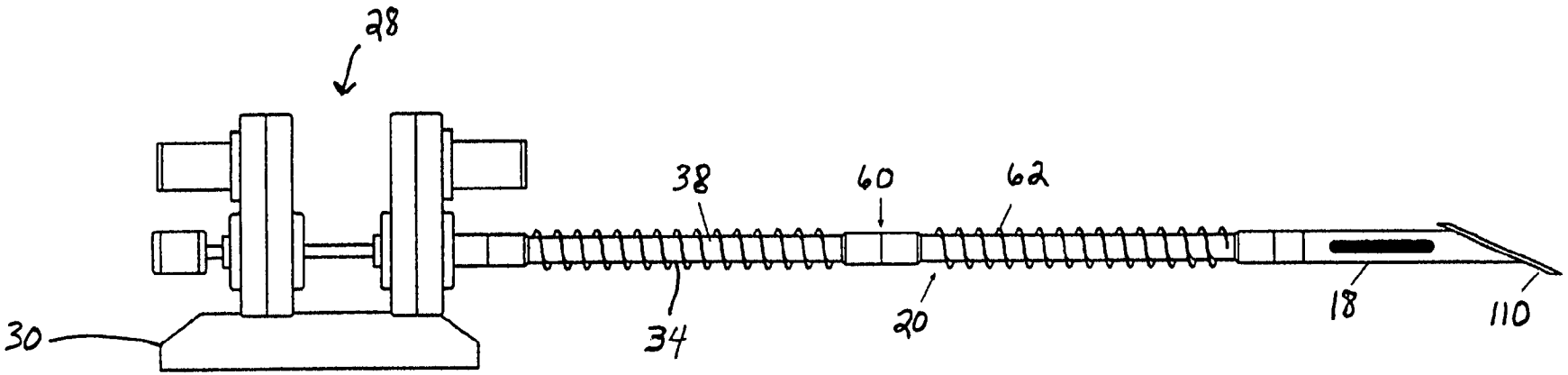
FIG. 5 is a diagrammatic side view of a dual-member drill string with flexible, helically-arranged projections disposed along an exterior surface of the outer drill string member.

Turning now to FIG. 5, shown is a side view depicting the present invention. Pipe sections 34 of the dual-member drill string 20 are connected to each other and to the downhole directional tool assembly 18 by way of tool joints 60. The dual-member drill string 20 preferably has substantially helically-arranged projections 62 disposed along an exterior surface of the outer member 38. As will become clear later, the projections 62 may encompass a broad range of substantially helically-arranged projections not limited to the "auger-like" flexible flighting depicted in FIG. 5. More preferably, at least some of the projections 62 exhibit flexural ability under axial and radial loading. Such loadings may occur at points of contact or along arcs of contact with the wall of the borehole 12 or with cuttings located therein. Depending upon the direction of load application and factors related to the design of those flexible projections 62, flexure will likely change their shape (profile) and height (radial component of the outer diameter, O.D.). Preferably, a nominal O.D. of these projections falls within a range bounded approximately by an inside diameter (I.D.) of the borehole 12 and an O.D. of the connective tool joints 60 between sections of the outer members 36. More preferably, the lower end of the range is greater than the tool joint O.D., while the upper end of the range is smaller than the I.D. of the borehole 12. This narrower range provides improved conveyance of drill cuttings across the tool joints 60 of the outer drill string 36, and also reduces the amount of rotational and axial drag created by the presence of the projections 62.

The projections 62 may vary in type and/or in their O.D. along the length of a particular segment 34 of the outer drill pipe 36. The projections 62 may also be continuous along a full length of a pipe segment 34 or the drill string. The drill string 20 may also be an assembly of pipe segments 34 differing with respect to their projections 62. It may be advantageous for these differing pipe segments 34 to be arranged in an ordered assembly so as to yield a repetitive pattern change (of projections) along the length of the drill string 20. Also, the type and arrangement of projections 62 at the downhole end of the drill string 20—in one or more pipe segments 34 near or immediately adjacent to a given downhole tool assembly—may differ from other pipe segments comprising the drill string. Further, a particular shape and/or arrangement of projections 62 may preferably be associated with a given downhole tool assembly 18 and/or soil condition.

In certain instances it may be advantageous for at least some intervals of the projections 62 to have a larger O.D. (e.g., by 10% or so) than the I.D. of the borehole 12. This results in the outer drill string 36 (because its projections 62 are integral thereto) being an interference fit within the borehole 12. By a controlled coordinated rotational advance (i.e., the proper number of revolutions per unit advance) of the outer drill string 36 in approximate direct relationship with the helical pitch of the projections 62, threaded engagement of the projections into the undisturbed soil surrounding the borehole 12 may then be accomplished. Where the inner drill string 38 can be advanced and retracted a short distance separately from the outer drill string 20 (FIG. 3), this threaded engagement may be utilized to augment the earth anchors 32 in resisting the thrust and/or pullback force of the drilling machine 10. Alternately, once the outer member 36 is so threadedly engaged, an increase in its rate of rotation per unit advance can be utilized to apply additional thrust force (or, for reverse rotation, apply additional pullback force) to the downhole tool assembly 18. This increased "thrust on bit" better enables penetration of "tough" spots encountered along the borepath, while lessening the risk of buckling the drill string 20—as might be the case if greater thrust were applied to the uphole end of the drill string 20 by the drilling machine 10. This capability may be particularly advantageous when attempting to advance the bit 110 without rotation, to make directional changes in the borepath 12. To avoid the above-mentioned drill string buckling concern, an interval of borehole engaging projections 62 is preferably positioned near the downhole end of the outer drill pipe 36.

Although the projections 62 shown in FIG. 5 are arranged in a helix of much shorter pitch than the length of the drill pipe segment 34, larger helical pitches are also envisioned—to include pitches so large as to yield only two to three or so turns around the typical 10 to 15 foot length of a pipe segment 34. Also, the apparent absence of projections 62 in the tool joint 60 intervals along the outer drill string 36 is not limiting upon the present invention—rather it is an illustrative simplification to improve visualization of a segmented drill string. If so desired, the tool joint intervals 60 may be bridged in various ways with projections 62—such as projections in the form of spirally placed welds or spiral-like appurtenances machined onto (i.e., beyond) the nominal tool joint outer diameter.

Figure 7:
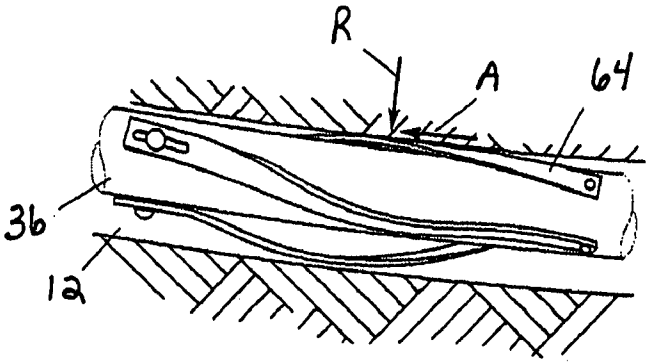
FIG. 7 is an enlarged sectional view of the drill string of FIG. 6 within the curved borehole.
Figure 6:
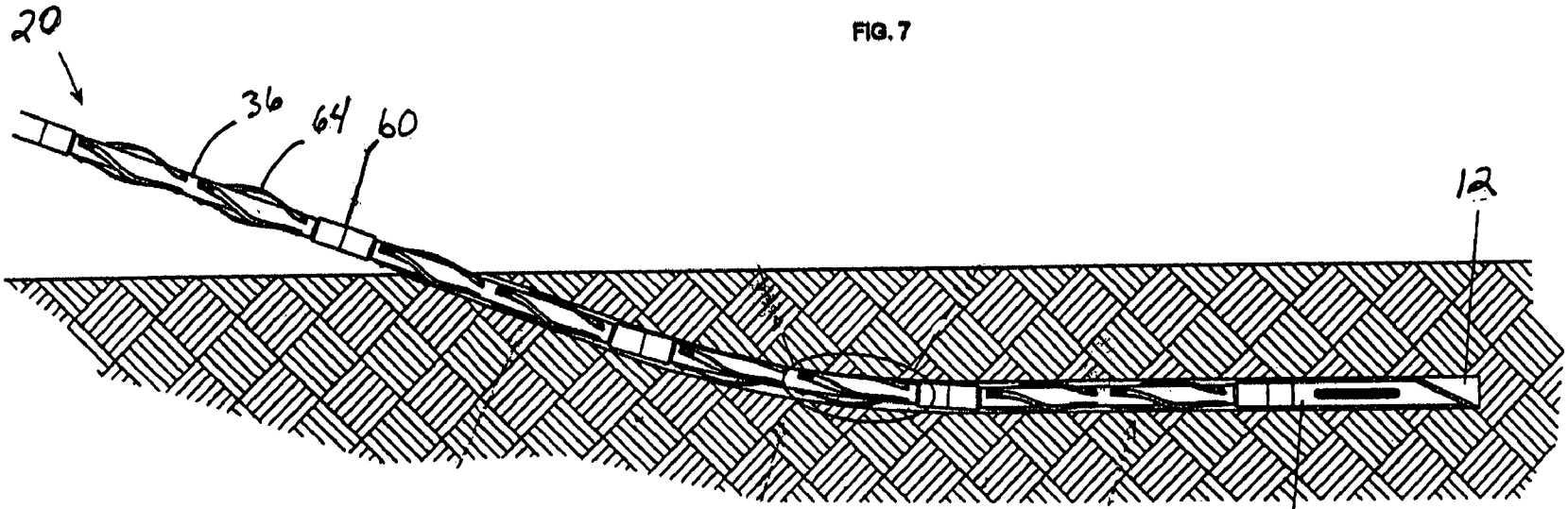
FIG. 6 is a sectional side view of the entry and horizontal segments of a borehole being created by an alternative embodiment of the present invention.

With reference now to FIG. 6, shown therein is a sectional side view of a borehole 12 being created by another embodiment for the dual-member drill string 20 of the present invention. As previously mentioned, the borehole 12 may be drilled with curved portions at the beginning and end of the bore. The severity of curvature for either transition is generally limited to an allowable bend radius of the drill string 20 or of the product (not shown) to be installed in the resulting borehole 12, whichever is larger. A portion of a curved transition of the borehole 12 is shown in FIG. 7 as an enlargement. This interval is the focal point of the present discussion.

As best seen in FIG. 7, the flexible projection 64 may be a series of spring steel shapes arranged in one or more rows spirally wrapped around the exterior surface of the outer members 36. Preferably, the projections 64 are constructed of "strap-like" material formed into a "bow" shape and twisted axially to coincide with the desired helix angle of their sequential arrangement. Each strap-like projection 64 may be attached to the exterior surface of the outer member 36 of the drill string 20 by a variety of techniques, so long as the desired maximum O.D. of their assembly is not exceeded and their inherent radial flexibility is not unduly impeded. For instance, proper positioning and sizing of a slotted connection to one end of the strap-like projection 64 can accommodate these two aspects. The outer extent of the slotted connection serves to restrain the arrangement of projections to a desired maximum O.D., while the inner end serves as a first stop in the radial collapse of each flexible bow-shaped projection 64. Additional radial collapse at a point of contact may occur if the contact loading is sufficient to distort the bow shape.

The strap-like projections 64 may be constructed from approximate rectangular cross-section material, such as flat bar stock having appropriate spring steel metallurgy. However, for purposes such as extended wear life and improved function, the cross-sectional material thickness may desirably be non-uniform (not illustrated). For example, constructing the flexible projections 64 from oval or half oval cross-section bar stock would reduce rotational drag on the drill string 20. Other bar stock cross-sections may also be utilized without detracting from the spirit of the present invention. Material thickness of the "bowed strap" may also be purposefully non-uniform lengthwise. For instance, wear life may benefit by gradually increasing material thickness toward its mid point of length, or by having a rounded enlargement at that location (not illustrated). A lengthwise mid point of the strap-like projection 64 should be considered equivalent to a central point of its greatest radial offset from the outer member 36.

The flexible projections 64 along the outer drill string member 36 can be in contact with portions of the borehole 12 wall that may vary according to particular operating modes of the HDD system 1. For instance during a directional change with the downhole tool assembly 18, the drill string 20 might be advanced with little or no rotation of its outer member 36 and no rotation of its inner member 38. The thrusting action necessary to initiate this directional change may "bow" the outer member 36 and its projections 64 against the bottom of the curved transition—opposite to that illustrated in FIGS. 6-7. Whereas, the configuration shown (i.e., contact with the top of the curved transition) may occur during rotational advance of the directional downhole tool assembly 18 in order to drill a straight segment of the borehole 12. In this operational situation, the thrust requirement on the drill string 20 is generally reduced, so the flexural stiffness (bending resistance) of the drill string may tend to hold it in contact with the top of the curved transition of the borehole 12. The illustrated contact may also be expected during pullback upsizing of the borehole 12. If the outer members 36 of the drill string 20 were rotated one revolution in the direction of the helix per an incremental advance equal to the helical pitch of the projections 64, helical line segments of contact would be created between the projections and the top of the borehole—similar to the previously described case of threaded engagement. The rotational speed of the outer member 36 of the drill string 20 will generally be faster or slower than this specialty situation. In these situations, the projections 64 in effect slide axially with respect to the wall of the borehole 12. This sliding creates axial forces (shown by "A" in FIG. 7) on the flexible projections 64, while contact against the borehole wall—such as along the top of the curved borehole transition—creates radial loading (shown by "R" in FIG. 7) on them. Of course, the particular projections 64 which are experiencing these loads change in relation to the rotation and translation (advance or retraction) of the outer drill string members 36. As earlier mentioned, such loadings can change the shape and radial height of the flexible projections 64. These changes are a desirable feature of the present invention; otherwise there may be greater tendency to "wallow out" the curved transition of the borehole 12 resulting in a potentially unacceptable shift in its alignment.

Rotation of the outer drill string members 36 creates another component of loading on the projections 64 whenever they are in contact with the borehole 12 or with cuttings therein. This loading (not shown in FIG. 7) would be directed in or out of the plane defined by the A and R forces. The load is directed approximately transversely tangential to the bowed strap projection 64. The resulting twisting action must be properly considered in the design of the projection and its attachments to the outer members 36 of the drill string 20.

Control of the outer drill string 36 by the dual-spindle rotary drive system 28 allows its rotational speed to be adjusted for optimum spoil removal for a given arrangement of projections 64 in particular soil conditions. Optimization is more readily accomplished by a control system 26 that automatically operates and coordinates rotational speed of the outer members 36 of the drill string 20 with the various other functions comprising the drilling operation. In this way, rotation can be held to the lowest speed that effectively aids spoil (cuttings) removal. This minimizes any tendency the flexible projections 64 may have to laterally "wallow out" the borehole 12 and unacceptably shift its alignment. An automated control system adaptable to the present invention is disclosed in commonly assigned U.S. patent application Ser. No. 10/617,975, the contents of which are incorporated herein by reference. As used herein, automatic operation is intended to refer to operations that can be accomplished without operator intervention and within certain predetermined tolerances.

Not withstanding their flexibility and controlled rotation, the projections 64 purposefully retain inherent capability of at least partially correcting undesired path variances that may occur along short intervals of an intended straight borehole. These undesired borepath variances might result when the downhole tool 18 encounters a soil variation (stratification, cobble, etc.) or because of inappropriate steering decisions (over-steering, improper timing, etc.). Many of these variances occur within a distance interval shorter in length than one or two drill pipe segments 34 (typically less than 20-30 feet). The resulting radial protrusions of surrounding soil into the desired borehole alignment are often abrupt enough to be intimately contacted by the sequential series of flexible projections 64 later passing by such locations. In effect, the protrusions become "point load supports" for the drill string 20 in a weight-supportive and/or flexural manner. Protrusions not at the "bottom" of the borehole are supportive in a flexural manner. Point loading creates much higher radial contact forces between the projections 64 and the protrusions than does the uniform contact inherent in a straight borehole. Repetitive axial and rotary sliding contact of the flexible projections 64 against the radial protrusions under high radial loading aids reduction of their radial offset. This "borehole straightening" capability may be particularly advantageous where the borehole 12 is intended for the installation of on-grade storm drainage or sewerage pipes. Critical alignments such as these cannot accept more than minor deviations from the planned borepath.

Many other configurations and shapes than shown in FIGS. 5-7 could suitably serve as the flexible projections 62 and 64, including: tines, bristles, paddles, ribbon auger, coiled spring segments, and outlying spiral lobes. The borehole contacting points of several such projections may be desirably modified in various ways to enlarge the contact area at this interface and thereby provide improved radial support. In the specific instance of a tine, this may be accomplished by bending its end into a supportive shape or by adding a rounded enlargement thereto. As previously discussed, a rounded shape reduces rotational drag.

Figure 8:
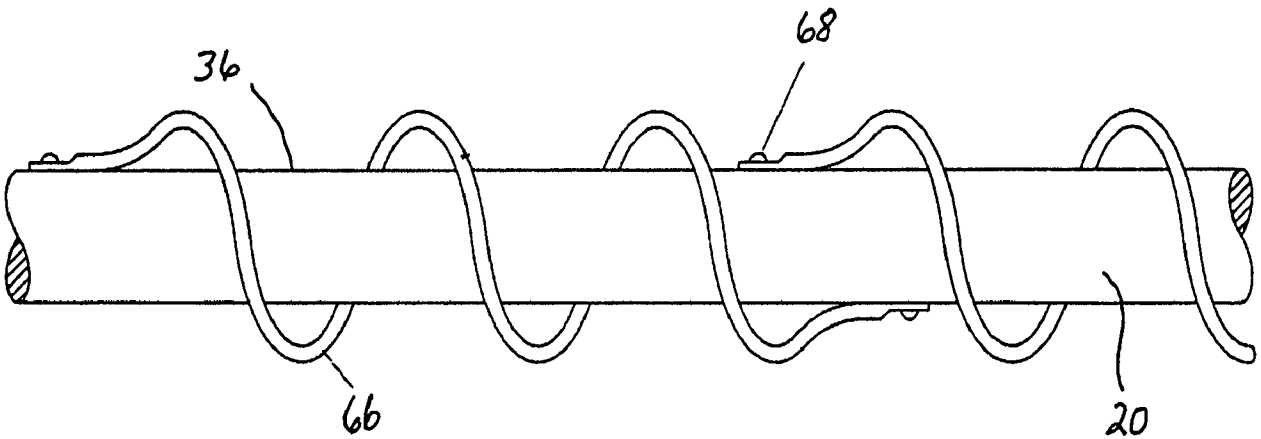
FIG. 8 is an enlarged, fragmented side view depicting another embodiment of the flexible projections of the present invention.

Flexible projections comprised of coiled spring segments 66 are illustrated in the embodiment of FIG. 8. These segments 66 comprise at least one wrap and may comprise multiple helical pitches coiled around the outer member 36 of the drill string 20. To accommodate specific soil conditions, the cross-sectional shape of the coiled spring 66 may be other than the circular shape illustrated in FIG. 8. For instance, an oblong or flattened circular cross-sectional shape may be more suitable in softer soils, while a rectangular shape may be more suited to harder soil conditions. (Note that a coiled rectangular shape would be similar in appearance to the flighting of a ribbon auger.) Each coiled segment 66 is mounted approximately concentric with the outer member 36 by way of supporting attachment points 68 at either end of the segment. For a multiple-wrapped coiled segment 66, additional supporting points (not shown) could be spaced between the ends of the segments. However, shorter overlapping coil segments 66—such as shown in FIG. 8—provide enhanced support without undo complication. The coiled projections 66 and their supporting ends 68 may be constructed of spring steel or other appropriate flexible and long-wearing materials.

Figure 9:
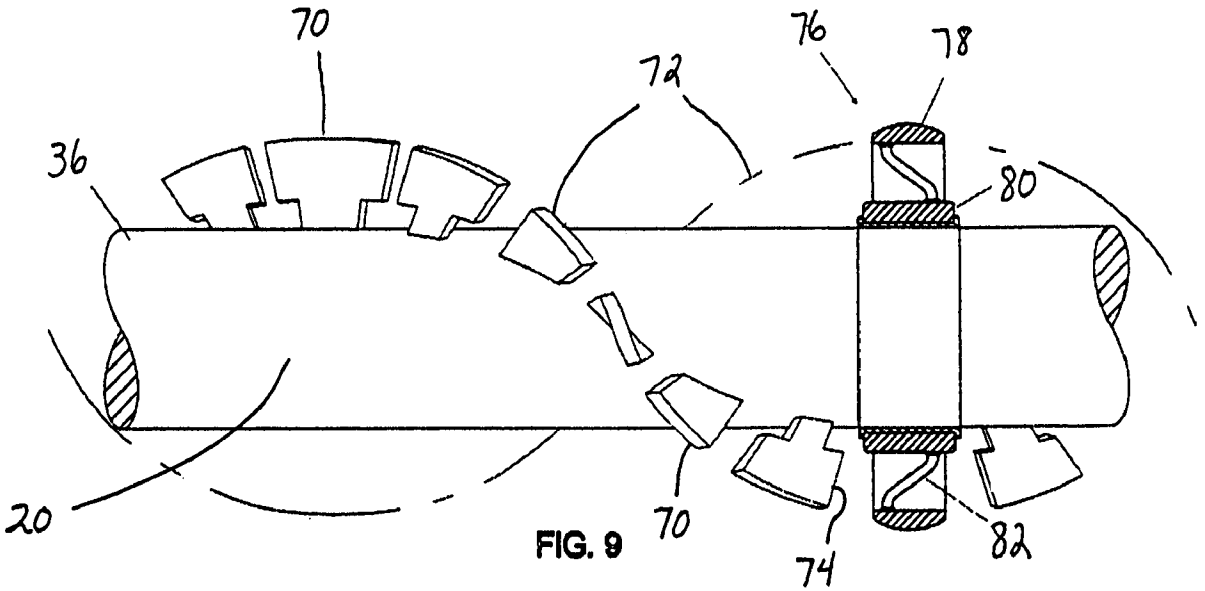
FIG. 9 is an enlarged, fragmented, partially sectional side view of yet another embodiment of the flexible projections of the present invention.

Turning now to FIG. 9, illustrated therein is yet another embodiment of the present invention. Paddle-like flexible projections 70 are attached to the outer member 36 of the drill string 20. The projections may be arranged in one or more helical rows 72 along and spiraling around the drill string. (The dashed helical line 72 shown in FIG. 9 represents the location where a second row 180° out of phase with the first row would be placed, if present). This arrangement is intended to aid the movement of spoil (cuttings) uphole whenever the outer member 36 of the drill string 20 is rotated clockwise as viewed from uphole looking downhole. (The downhole direction is toward the right in all Figures herein.) Other arrangements may also be acceptable toward this purpose. The illustrated approximate radial orientation of the projections 70, i.e., perpendicular with respect to the axial orientation of the drill string 20, may be desirable where the outer member 36 of the drill string has bi-directional rotational (clockwise and counter-clockwise) capability and/or is expected to undergo axial pullback (i.e., bi-directional axial motion). Canting the paddle-like projections 70 uphole (toward the left in FIG. 9) may be beneficial in certain soil conditions, or where pullback of the drill string 20 is not planned. Although the paddle-like flexible projections 70 are shown in FIG. 9 as being arrayed tangent to their particular helical line 72, other relationships are acceptable. For instance, arranging the projections 70 transversely to their respective helical lines 72 may be beneficial when more than two lines 72 of projections 70 are fitted around the outer drill string 36.

Some or all of the paddle-like projections 70 may have enlargements 74 at their outer ends. The enlargement 74 may have increased thickness (not illustrated) as well as an extended arc length at points of potential contact with the borehole 12 wall. As previously mentioned, enlargements at the outer end of certain types of flexible projections may be useful for wear resistance and for enhanced support of the drill string 20 within the borehole 12. The latter feature will mitigate the tendency that some non-augmented projection shapes could have to unduly redefine the borepath (wallow out the borehole in one or more radial directions). End enlargements 74 also may be beneficial in reducing the amount of rotational and axial drag created by the presence of the flexible projections 70. This is particularly the case when the projections 70 have a gradation in their radial height along the drill string 20, as illustrated in FIG. 9. Taller (larger O.D.) intervals of the projections 70 are shown in FIG. 9 toward the left and right of center for the segment 34 of the drill string 20. These projections 70 have end enlargements 74 to provide supportive contact with the borehole 12 wall, thus freeing the shorter projections from this contact.

When its propelling drill string 20 is held in approximate alignment with the borehole 12 centerline, the downhole tool 18 (as well as other downhole tools described herein) often has less difficulty holding a given borehole alignment. Thus the centralized support offered by the larger O.D. projections 70 is a feature particularly useful toward holding alignment in on-grade boring applications. In certain situations, including softer soil conditions, it may be advantageous to augment this supportive feature by the placement of centralizers or bearing supports 76 at intervals along the drill string 20. The centralizer supports 76 may be positioned within the bands of taller, end-enlarged projections 70—as shown in FIG. 9. Alternately, they may be placed in the midst of the shorter projections. Depending upon the positional placement of a drill pipe segment 34 within the drill string 20 and the length of the segments, it may be beneficial to have as many as three bearing supports 76 spaced along a segment of the drill string 20. However, adjacent pipe segments 34 within the drill string 20 may be fitted with differing numbers of supports 76 and some pipe segments may have none at all. Thus various supportive arrangements of the drill string 20 can be configured by sequential addition of appropriately equipped drill string segments 34. For instance, closer spacing of the supports 76 may be more beneficial at the downhole end of the drill string 20 for reasons mentioned earlier.

The centralizer supports 76 may be comprised of an outer rim 78 flexibly supported on a bearing hub 80 by an arrangement of spokes 82. The outer member 36 of the drill string 20 may thus be rotated without causing rotation of the outer rim 78 of the support 76. The outer rim 78 is preferably of contoured cross-section and diametrically sized to be a slip fit within the borehole 12, and preferably has a smooth or scalloped (not illustrated) circumferential surface. The outer rim 78 is preferably purposefully constructed to flexibly distort from circular engagement with the borehole 12 to an oblong or point-wise indented shape as may be necessary to pass over protrusions from the wall of the borehole or to pass through out-of-round intervals of borehole. The rim 78 is also preferably flexible to shift uphole or downhole (left or right in FIG. 9) with respect to its hub 80 under axial loadings associated with such protrusions and out-of-roundness. This and other features of the rim 78 reduce the likelihood of it becoming wedged in the borehole 12. The relative movement and point-wise indention capability is accommodated by flexibility inherent in the material and shape comprising the spokes 82. The spokes 82 are preferably constructed of spring steel bent into a shape that purposefully aids the above-desired flexibility of the outer rim 78.

The various flexible helical projections 62, 64, 66, and 70 described herein are particularly beneficial—by way of their agitating effect while being rotated by the outer drill string 36—in keeping drill cuttings (spoil) in suspension within the drilling fluid being injected during the drilling process. For conventional HDD drilling machines, periods of non-rotation of the drill string occur whenever a new segment 34 of drill pipe must be added to the drill string 20. Flow of drilling fluid into the borehole 12 also ceases during this time. This period of inactivity equates to stagnation within the borehole 12, which may be particularly detrimental toward holding larger or heavier cuttings in fluid suspension—such as those created while drilling through rock formations. The drilling machine 10 of the present invention has been adapted to eliminate this period of stagnation by instituting capability for rotation of the outer drill string member 32 after it has been disconnected from the rotary drive 24.

Figure 10:
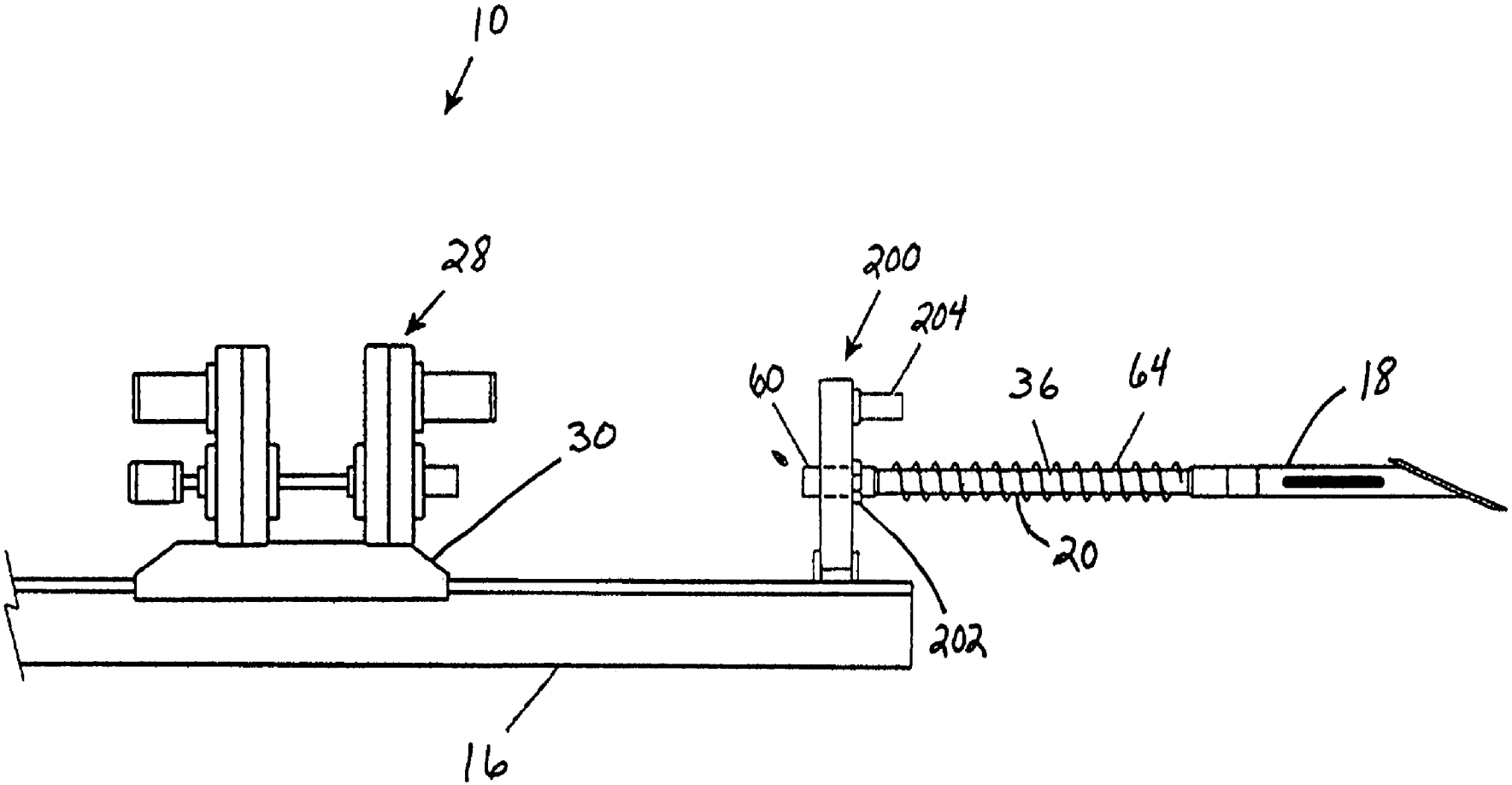
FIG. 10 is a fragmented side view of the drilling machine of FIG. 1 showing an adaptation to a front wrench.

With reference now to FIG. 10, the drilling machine 10 further comprises a front wrench 200. The front wrench 200 of the present invention is adapted to rotate the outer member 36 of the drill string 20 while maintaining a grip on the upper most tool joint 60 at the uphole end of the drill string. The front wrench 200 comprises a pipe grip 202 and a rotary drive 204.

The front wrench 200 operates when the drill string 20 has been advanced sufficiently that the upper most tool joint 60 is positioned at the front wrench (or the drill string has been retracted sufficiently that an outer member tool joint is positioned at the front wrench and the breakout wrench (not shown)). The rotary drive system 28 of the drilling machine 10 is disconnected from the drill string 20 to allow the addition (or removal) of another pipe segment 34. [Note: For clarity, the breakout wrench is not shown in FIG. 10. It would preferably be located immediately to the left of the front wrench 200.] Typically this disconnection is accomplished by—among other actions—gripping the tool joint 60 located at the uphole end of the drill string 20 to prevent its rotation. The pipe grip 202 of the wrench 200 is adapted to secure the tool joint. Preferably, the pipe grip 202 comprises a set of engagable vise jaws. The rotary drive 204 within the front wrench 200 of the present invention may be comprised of a gear arrangement (not shown) supporting the vise jaws 202. The gear arrangement is preferably driven by a hydraulic motor. Such an arrangement would be purposefully designed with sufficient rotational torque capacity to turn the outer member 36 of the drill string 20 within a borehole 12 and, by way of the flexible projections 62 thereon, agitate the drill cuttings. A brake (not shown) may be actuated to lock the rotary drive 204 of the wrench 200 during the conventional process of making and breaking tool joint 60 connections. The outer member 36 of the drill string 20 could alternatively be rotated by a rotary drive separate from the front wrench 200. Such a separate drive would be located directly ahead of a conventional front wrench. The outer member 36 of the drill string 20 could then be rotated upon release of the front wrench.

Once the initial borehole 12 has been completed, it is often necessary to upsize the hole diameter to accept the product being installed. The present invention has utility in this process as well. The auger-like flexible projections 62, 64, 66, and 70 of the present invention are particularly helpful in aiding the transport of reamer cuttings out of the borehole 12. Several different system configurations may be utilized for upsizing the borehole 12 and installing product. For instance, the borehole 12 is typically upsized by a backreaming process wherein a reaming device is pulled back toward the drilling machine 10 after the initial borehole has been completed. However, the borehole 12 may also be upsized by a forward reaming process wherein a reaming device is pushed in the opposite direction by a drill string 20. Forward reaming is particularly suitable for "blind boreholes"—as illustrated in FIG. 11—that cannot have an ending (target) pit or a surface exit point. Such boreholes 12 are frequently desirable in environmental monitoring and remediation applications, as well as in other applications where sensors or equipment are to be placed underground.

Figure 11C:
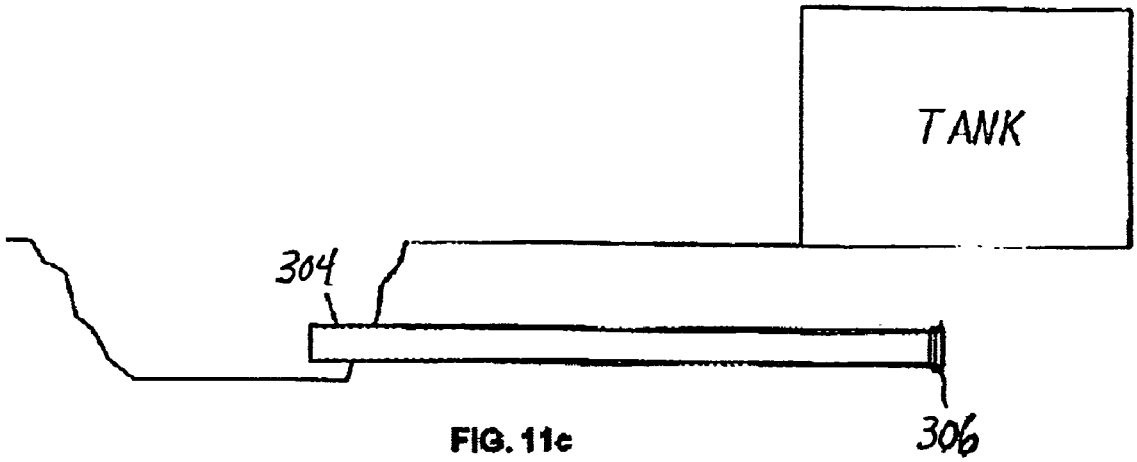
FIGS. 11*a*-11*c* are a series of diagrammatic, partially sectional side views depicting utilization of the helically-arranged projections of the present invention during the forward-reaming upsizing of the borehole.
Figure 11B:
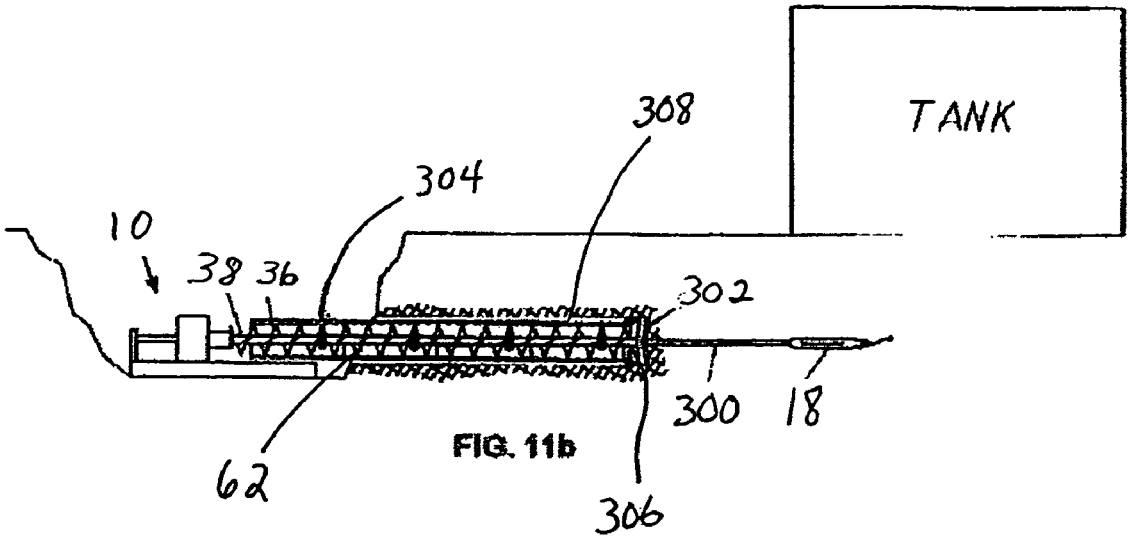
Figure 11A:
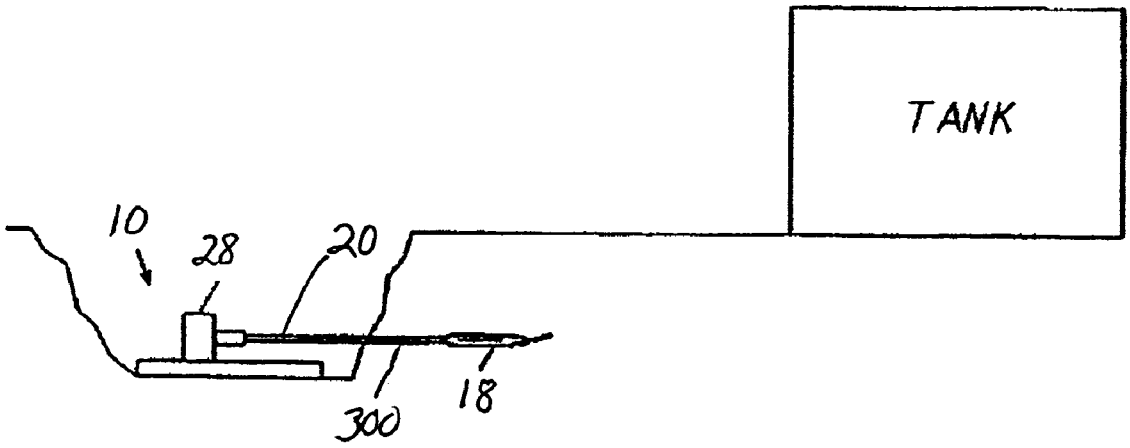

With reference now to FIG. 11, three stages of a blind hole forward reaming installation are shown. In this example, a pit-launched HDD drilling machine 10 is utilized. However, a surface-launched drilling machine as described previously is also suitable for this purpose. The borehole 12 may be initiated (FIG. 11*a*) in one of the manners previously described, wherein the drilling machine 10 is adapted for utilizing a dual-member drill string 20. The inner drill string member 38 is equipped with a directional downhole tool assembly 18 to direct the borehole 12 along the desired path. As will now be explained, the leading end of the inner drill string member 38 in effect serves as a guide rail for the forward reaming outer drill string member 36. Alternatively, a conventional single member drill string can be used to drill the initial portion of the borehole.

In this first operational stage, shown in FIG. 11*a*, as little as one segment 300 or up to several segments of the inner drill string member 38 are preferably drilled along the desired path. The length drilled before adding the outer member 36 is dependent upon the lateral support offered by the local soil conditions. This may be enhanced by selecting an inner drill string member 38 of O.D. nearly as large as that of the downhole tool 18, and/or by the addition of centralizers (not shown) along these initial segments 300 of the inner drill string.

Referring now to FIG. 11*b*, the outer drill string 36 having auger-like projections 62 is slidably fitted around and sequentially advanced in conjunction with the guide segments 300 of the inner drill string 38. Thus the drill string 20 behind the guide segments is a dual-member drill string. The first guide segments 300 serve as a guide rail, forcing the outer drill string member 36 to follow the same borepath 12 direction. A cutting head 302 suitable for borehole upsizing is placed at the downhole end of the outer drill string 36. The cutting head 302 may be rotationally coupled to the outer drill string 36, or alternately driven. An arrangement of gears (not shown) could comprise the rotational coupling to the outer drill string 36, enabling it to be rotated at a different speed (faster or slower in relation to the gear ratio) than the cutter head 302. Suitable arrangements for such gearings are shown in commonly assigned U.S. Pat. Publ. No. 2005-0029016. In operation, the spoil (cuttings) conveying capability of the auger-like projection 62 attached to the external surface of the outer member 36 of the drill string 20 can more readily be matched to the excavation rate of the cutter head 302.

A casing 304 is slidably fitted over the flexible-flighted 62 outer drill pipe 36. The casing 304 may be steel pipe or other product desired to be installed. Alternative casings of a more flexible material can be utilized—such as high-density polyethylene (HDPE), polyvinyl chloride (PVC) or similar materials. Flexible casing is beneficial when the desired borehole 12 contains curvilinear segments. A flange 306 connected to a downhole end of the casing 304 serves to protect the casing from the rotating cutting head 302. The flange 306 also prevents cuttings from plugging off a narrow relief annulus 308 between the casing and the upsized borehole 12. Were this plugging to occur, advance of the casing 304 may be impeded. Preferably, the cuttings are conveyed uphole in an annulus between the casing 304 and the exterior surface of the outer member 36 of the drill string 20—being substantially aided by rotation of its flexible flighting 62. The large volumes of drilling fluid associated with typical borehole upsizing processes may thus be substantially reduced, and in some cases essentially eliminated. This aspect is particularly advantageous for the above-mentioned environmental applications.

The protective flange 306 may have provisions (not shown) to transfer a towing force to the downhole end of the casing 304—utilizing a portion of the thrust applied to the cutter head 302 by the outer drill string member 36. In addition (or alternately), the drilling machine 10 may have provisions (not shown) for applying a pushing force on an uphole end of the casing 304 to move it into the reamed borehole 12 in concert with the drill string 20. Casing pushing techniques are well-known and need not be described herein.

With continued reference to FIGS. 11*b* and 11*c*, it should be clear that the downhole directional tool 18 must advance beyond the desired end point of the final cased or lined borehole 12. Where the drilling machine 10 to continue to advance the dual-member drill string 20 in lock-step, the directional tool 18 will then be located the length of the guide segment(s) 300 beyond the desired end point. In some applications it may be undesirable to disturb the soil for such a distance beyond the end of the installed casing 304. The feature described in respect to FIG. 3, for axially advancing the outer members 36 of the drill string 20 with respect to the inner members 38, may be utilized to move the cutter head 302 toward the directional tool 18 once the tool has cleared the desired end point. The resulting disturbed interval will then be limited to the length of the directional tool 18 alone.

Once the casing 304 has been advanced to the desired point in the borehole 12, a collapsible feature built into the cutter head 302 allows it to be retracted into the casing. Such collapsible features are commonly known and need not be described herein. Alternately, a sacrificial cutter head 302 could be fitted to the outer drill string 36 then released and abandoned in the borehole 12. In stage 3 of the process, shown in FIG. 11*c*, the outer 36 and inner members 38 of the drill strings are withdrawn from the borehole—leaving the casing 304 in place.

Figure 12:
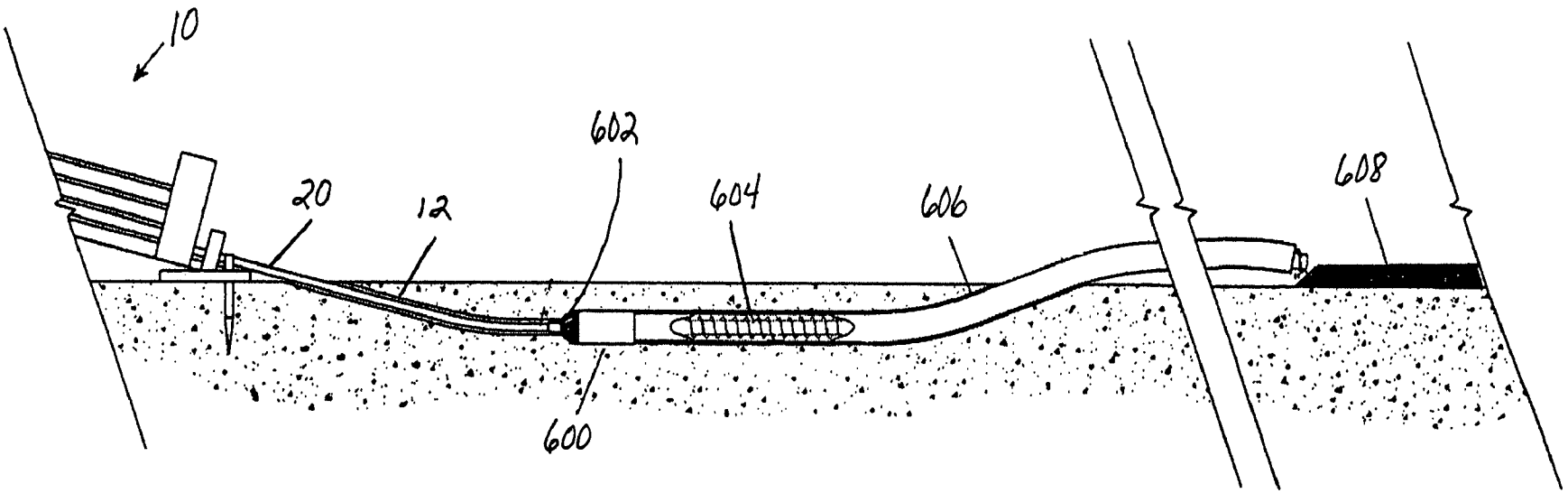
FIG. 12 is a diagrammatic representation of an backreaming operation utilizing the present invention.

Referring now to FIG. 12, there is shown therein the more typical borehole upsizing process known as "backreaming"—wherein the borehole 12 is enlarged as the drill string 20 is drawn back toward the drilling machine 10. For a backreaming operation, a downhole tool assembly 18 preferably comprises a backreaming assembly 600 connected to the downhole end of the dual-member drill string 20 after the drill string has exited the distal end of the initially created borehole 12. As shown in FIG. 12, the drill string 20 is being withdrawn from the borehole 12. In effect, the backreaming assembly 600 is advancing toward the drilling machine 10 as it upsizes the borehole 12 to a larger diameter.

The backreaming assembly 600 may comprise a backreaming apparatus 602 and a spoil (cuttings) conveying arrangement 604. The conveying arrangement 604 is preferably disposed within a casing 606 or product to be installed in the borehole 12. The casing 606 may be a temporary or permanent liner for the upsized borehole 12. Alternately, in certain supportive soil conditions such as continuous rock, the assembly 600 may be utilized without a casing. The casing 606 may be steel pipe. Alternately, a more flexible material can be utilized—such as high-density polyethylene (HDPE), polyvinyl chloride (PVC) or similar materials. The casing 606 and its internal conveying arrangement 604 may be pre-assembled into one continuous length prior to initiation of the borehole 12 upsizing process. Where available space is limiting, pre-assembly may alternately be as two or more segments to be interconnected as the first and subsequent segments are drawn into the upsized borehole 12.

Drilling fluid is typically pumped downhole through the drill string 20 to aid the removal of sufficient cuttings (spoil) 608 to create diametrical space for installation of the casing or product pipe 606. The present invention is particularly suited for aiding this removal process. It is also suitable for this same purpose with particle-creating dry boring techniques, such as those that utilize high volume air for cuttings removal. For larger diameter casings or pipes 606 the borehole 12 upsizing process may involve multiple passes through the borehole to increase its size in a step-wise manner. Sequentially larger diameter backreaming assemblies 600 would be utilized in that case. The conveyed spoil 608 may be discharged from the trailing end of the pipe 606 and deposited in a window along the ground surface as the pipe advances into the borehole 12. Alternately, a spoil collection apparatus (not shown) such as a vacuum truck may be adapted to the discharge point to minimize site disturbance.

Figure 13:
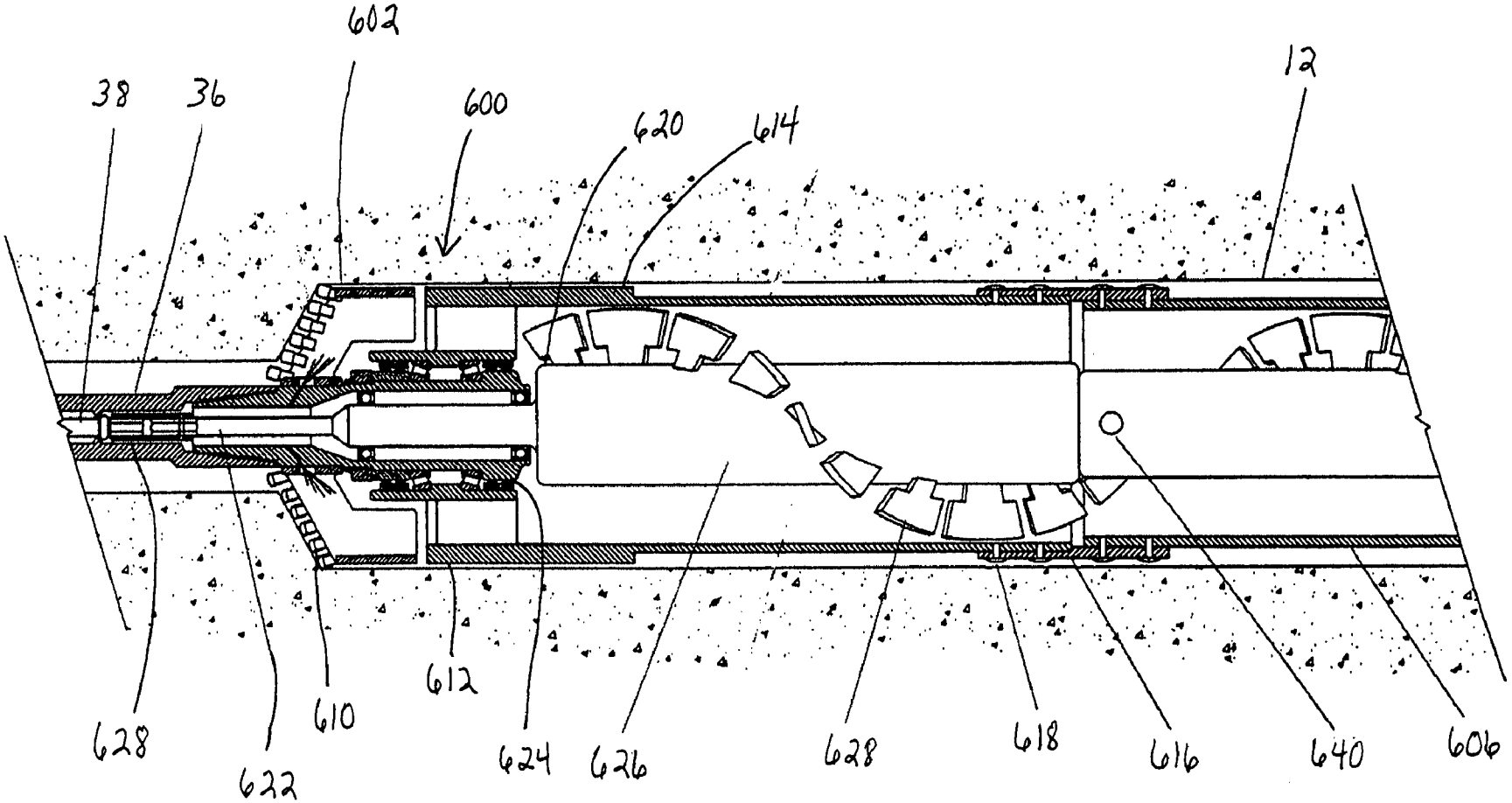
FIG. 13 is an enlarged, fragmented side elevational, partly sectional view of the backreaming downhole tool assembly of FIG. 12 wherein the spoil (cuttings) conveying arrangement is depicted as flexible, auger-like appendages along a shaft or tube internal to the casing or product pipe.

Turning now to FIG. 13, and with continued reference to FIG. 12, the assembly 600 is comprised of a backreaming apparatus 602. The backreaming apparatus 602 may be a steerable or non-steerable reamer. Steerable reamers are disclosed in U.S. Provisional Patent Application Ser. No. 10/813,824, incorporated herein by its reference. The backreaming apparatus 602 may comprise a cutting face 610 and a support barrel 612, wherein the cutting face is rotationally disconnected from the support barrel. At the junction between the cutting face 610 and the barrel 612, a flange 614 on the support barrel of approximately the same diameter as the upsized borehole 12 prevents more than an inconsequential amount of the reamer cuttings from entering the annulus between the upsized borehole 12 and the support barrel—and later the casing 606. Alternately the support barrel 612 itself may be a close fit in the borehole 12, thereby eliminating need of the flange 614. Either of these techniques minimizes the possibility for the casing 606 to become bound up before it has been completely drawn into the borehole 12. The support barrel 612 preferably comprises provisions at an opposite end—such as connection collar 616 and fasteners 618—for an axially aligned and substantially sealed connection to the casing 606. The slurried reamer cuttings are thus encouraged to find other pathways to the surface. Some cuttings may flow toward the drilling machine 10, for instance through an annulus between the drill string 20 and the borehole 12 or through an annulus between the inner 38 and outer members 36 of the drill string. This direction of flow may be encouraged by utilizing the previously described flexible projections 62 attached to the outside of the outer member 36. Alternatively, projections may be attached to the inside (not shown) of the outer member of the drill string if the flow path for spoil is the inter-pipe annulus.

An alternate and usually preferred flow path for the reamer cuttings is in the opposite direction. Cuttings pass through purposeful openings (not shown) in the cutting face 610 and enter the support barrel 612. An auger-like arrangement 620 rotating within the support barrel 612 and the casing 606 enables the cuttings to be readily moved toward the distal end of the casing or of the borehole 12. The auger arrangement 620 comprises a drive shaft 622 adapted to be connected to the drill string 20, a bearing arrangement 624, and an auger shaft 626. One member of the dual-member drill string 20 is utilized to rotate the auger arrangement 620, while the other member rotates the cutting face 610. Preferably, the outer member 36 of the drill string 20 is used to rotate the cutting face 610, while the inner members 38 rotate the auger arrangement 620 by way of a geometrical connection 628 to the drive shaft 622. The drive shaft 622 is supported in the barrel 612 by the bearing arrangement 624. The bearing arrangement 624 allows the auger shaft 626 to rotate within and independent of the barrel 612. The auger shaft 626 has flexible helical flighting projections 628 similar to those previously described and is preferably extended into and along the casing 606. Alternately, the auger shaft 626 could be a ribbon auger with or without a shaft or central tube.

Torque-multiplying arrangements of gears (not shown) could comprise either or both rotational connections of the dual-member drill string 20 to the backreaming assembly 600. This may be particularly beneficial for the auger arrangement 620 being driven by the inner drill string 38 and its drive group 52 (FIG. 3), which typically have a higher speed and a lower torque capability than the outer drill string 36 and its drive group 50. For instance, the inner members 38 may have up to two (2) times greater rotational speed capability but might deliver less than one-third (⅓) the torque capability of the outer members 36.

When the product pipe is utilized for the casing 606, it must be protected from undue internal wear and abrasion from the passage of reamer cuttings. This may be accomplished by utilizing low rotational speeds for the auger arrangement 626 in combination with special features such as periodic bearing supports 76 (FIG. 9) along the auger shaft 626 and enlargements such as a helical ribbon (not shown) coiled around the outer diameter of the flexible helical flighting 628. For ease of assembly and disassembly, a torque transmitting coupling arrangement 640 may be utilized at points along the auger shaft 626—such as at the junction between the support barrel 612 and the pipe or casing 606 and at intervals of convenience thereafter. This also accommodates a differing O.D. auger arrangement 620 within the pipe 606, as may be necessary in relation to that within the support barrel 612.

The control system 26 (FIG. 1) on the drilling machine 10 may be utilized to adjust and hold the rotational speed of the auger arrangement 620 in proper relation to the pullback rate of the drill string 20 so as to effectively remove the reamer cuttings. The volume (amount) of cuttings being conveyed along the length of the casing 606 creates a relational (approximately proportional) torque loading on the auger arrangement 620 that may be sensed as another feedback parameter in the control logic. An overload situation can be avoided by properly adjusting the pullback rate, and also by injecting the appropriate volume (flow rate) of drilling fluid at and behind the cutting face 610 to slurry the cuttings and lubricate their flow path (i.e., the interior of the casing 606).

Once the backreaming assembly 600 has been pulled back to the drilling machine 10, the backreaming apparatus 602 is removed and the auger arrangement 620 is withdrawn from the casing or product pipe 606. Assuming the pipe 606 is to remain in the upsized borehole 12, its interior may then be cleaned of any remaining cuttings by conventional techniques—such as by passing a foam or other type of "pig" through the pipe with the aid of compressed air.

Various modifications can be made in the design and operation of the present invention without departing from the spirit thereof. Thus, while the principal preferred construction and modes of operation of the invention have been explained in what is now considered to represent its best embodiments, which have been illustrated and described, it should be understood that the invention may be practiced otherwise than as specifically illustrated and described.

What is claimed:

1. A method for creating a horizontal borehole using a dual member drill string, the method comprising:

rotating a cutting tool using a first member of the dual member drill string, wherein the cutting tool comprises a backreaming tool;

introducing a product into the borehole created by the cutting tool;

clearing spoils and drilling fluids by rotating an auger using a second member of the dual member drill string, wherein the auger is disposed within the product; and pulling the backreaming tool through the borehole using the dual member drill string;

wherein the first member of the dual member drill string comprises an outer member of the drill string such that the backreaming tool is rotated by the outer member by applying a force to the outer member at a first end of the drill string; and wherein the second member of the dual member drill string comprises an inner member of the drill string such that the auger is rotated by the inner member by applying a force to the inner member at a first end of the drill string.

2. A method for boring a horizontal borehole, the method comprising:

boring a first portion of a borehole using a single member drill string;

boring a next portion of the borehole using a dual member drill string having a plurality of helical projections supported on an outer surface of an outer member of the dual member drill string;

wherein the single member drill string comprises an inner member of the dual member drill string such that the inner member rotates independently of the outer member; and wherein the helical projections contact a wall of the borehole during the boring step.

* * * * *